US011358150B2

(12) United States Patent
Zhang

(10) Patent No.: US 11,358,150 B2
(45) Date of Patent: Jun. 14, 2022

(54) ROLLER PRESS CAPABLE OF APPLYING ELECTRIC FIELD

(71) Applicant: Henan University, Kaifeng (CN)

(72) Inventor: Jingwei Zhang, Kaifeng (CN)

( * ) Notice: Subject to any disclaimer, the term of this patent is extended or adjusted under 35 U.S.C. 154(b) by 217 days.

(21) Appl. No.: 16/623,322

(22) PCT Filed: Aug. 16, 2018

(86) PCT No.: PCT/CN2018/100724
§ 371 (c)(1),
(2) Date: Dec. 16, 2019

(87) PCT Pub. No.: WO2019/034092
PCT Pub. Date: Feb. 21, 2019

(65) Prior Publication Data

US 2021/0146373 A1 May 20, 2021

(30) Foreign Application Priority Data

Aug. 17, 2017 (CN) ..... 201710704861.1
Aug. 17, 2017 (CN) ..... 201721028890.2

(51) Int. Cl.
*B02C 4/02* (2006.01)
*B02C 19/18* (2006.01)
*B02C 4/28* (2006.01)
*B02C 4/32* (2006.01)

(52) U.S. Cl.
CPC ..... *B02C 19/18* (2013.01); *B02C 4/02* (2013.01); *B02C 4/286* (2013.01); *B02C 4/32* (2013.01); *B02C 2019/183* (2013.01)

(58) Field of Classification Search
CPC ..... B02C 19/18; B02C 2019/183; B02C 4/02; B02C 4/286; B02C 4/32; B02C 4/42
See application file for complete search history.

(56) References Cited

U.S. PATENT DOCUMENTS 3,460,766 A * 8/1969 Sarapuu ..... B02C 19/18 241/1
3,473,940 A * 10/1969 Walsh ..... G03G 17/04 106/402
3,833,493 A * 9/1974 Zucker ..... G03G 17/04 430/34
4,084,496 A * 4/1978 Ehernberger ..... B03C 1/16 100/35
4,447,694 A * 5/1984 Brochier ..... B26F 3/06 219/384

(Continued)

*Primary Examiner* — Faye Francis
(74) *Attorney, Agent, or Firm* — Novoclaims Patent Services LLC; Mei Lin Wong

(57) ABSTRACT

A roller press machine capable of applying an electric field includes a base, a frame, press rollers, a distance adjusting device, a speed adjusting device, a voltage applying device, a feeding baffle, and a discharging device. The press roller has a roller surface made of conductive material, and an electric field is created when a charge is applied to the press roller. In the roller press, an alternating or direct current electric field is applied between the press rollers to create an electrochemical action, such that particles or a solution in a system is induced to undergo a physical or chemical change, thereby enhancing interaction therebetween, and accordingly increasing grinding and dispersion efficiency of a solid-liquid dispersion system.

19 Claims, 4 Drawing Sheets

(56) References Cited

U.S. PATENT DOCUMENTS

| | | | | |
|---|---|---|---|---|
| 5,782,177 | A * | 7/1998 | Rindfleisch | B29C 43/24 100/168 |
| 5,865,381 | A * | 2/1999 | Mitsumura | B01J 2/10 241/18 |
| 6,586,151 | B1 * | 7/2003 | Naka | G03G 9/0827 430/137.2 |
| 7,311,277 | B2 * | 12/2007 | Watanabe | B02C 18/0007 241/101.2 |
| 2008/0073453 | A1 * | 3/2008 | Watanabe | G06K 1/128 241/25 |
| 2016/0041491 | A1 * | 2/2016 | Suzuki | G03G 15/0233 399/176 |

* cited by examiner

ROLLER PRESS CAPABLE OF APPLYING ELECTRIC FIELD

BACKGROUND OF THE PRESENT INVENTION

Field of Invention

The present invention relates to dispersion and grinding of liquid-liquid or solid-liquid two-phase dispersion system, and more particularly to a shotcrete machine for tunnel boring machine.

Description of Related Arts

Nanotechnology can fundamentally change many traditional products. Adding nanoparticles or nanomaterials to traditional materials can improve or achieve a series of functions. For example, if nanotechnology is applied in paints, inks or coatings, it not only greatly increases the coverage rate, but also extends the aging time of materials and saves raw materials. The addition of a small amount of metal nanoparticles to chemical fiber fabric can get rid of the static phenomenon caused by friction. The addition of nanomaterials to foods, pharmaceuticals, and cosmetics will greatly increase the absorption rate of effective substances by the human body. Nanoceramics have been widely used in computer, aerospace and military fields. Therefore, nanotechnology has quietly brought about changes in human life and will become a revolutionary technology.

Nanotechnology firstly prepares powder materials with nanometer scale by a certain method. When the particle size of the powder is reduced from 10 um to 10 nm, the particle size is changed by 1000 times, and when converted to volume change, the change will be $10^9$ times. The physical and chemical properties of the two are very different, which reflects the strange surface effects, quantum size effects and high chemical reactivity of nanoparticles, and involves the fields of chemistry, physics, materials science and molecular biology. The huge surface area and surface energy of the nano-powder make it extremely easy to agglomerate. It is difficult to disperse in the specific application, and it is difficult to disperse. The only way is to depend on the nature of the medium being applied to make corresponding modification of the surface so as to make the nano-powder disperse evenly into the medium and exert the effect of nanomaterials.

The manufacturing method of the micro/nanoparticle material includes a chemical method, a mechanical method, and etc.

Roller press machine is a material mixing and grinding device commonly used in industry. It is mainly used for mixing, grinding and dispersing of liquid paste and paste materials such as paint ink, pigment paint, cosmetics and rubber. For a two-phase dispersion system (such as a solid-liquid two-phase system composed of solid particles and a solvent, or an oil-water two-phase dispersion system). The transfer of the material on the roller surface of the roller press can be regarded as the flow of the fluid between the rollers and the roller surface. The pressing and friction of the roller press on the dispersed phase are mainly concentrated in the gap between the rollers. At this time, the rotation of the roller press causes the particles in the dispersion system to be pressed and rubbed with each other between the rollers, and the difference in speed between the rollers will exert a frictional shear force on the material to achieve the purpose of mixing, grinding and dispersion.

However, in some cases during actual application, due to the mismatch between the surface energy, polarity or affinity of the two-phase system, the interaction between the particles and the solvent is weak, and the frictional shear force generated during the rotation of the roller press is difficult to be transmitted to the solid particles, the crushing and dispersion effect is relatively poor.

If an alternating and direct electric field can be applied between the rollers, by introducing an electrochemical regulation, the particles or solutions in the system are induced to undergo physical changes such as interfacial polarization and viscosity change, or even chemical intercalation or chemical reactions, the interaction force between each other can be increased, which will help to improve the efficiency of grinding and dispersion. At the same time, for oriented particles such as one-dimensional fibers and two-dimensional lamellar materials, an orientation alignment can be produced under the action of an electric field, which helps the shear force to act in a certain target direction, hence resulting in a unique grinding effect.

SUMMARY OF THE PRESENT INVENTION

The present invention is directed to the above problems, and provides a roller press machine capable of applying an electric field. The roller surface of the roller press machine is made of a conductive material, and a direct current electric field or an alternating current electric field can be applied between the press rollers by rubbing the roller surface by a brush or the like during operation. The conventional roller press machine mainly utilizes the shearing force between the rollers and the rolling pressure to realize the pulverization and solid-liquid dispersion of the solid particles. The roller press machine of the invention not only has the function of a conventional roller press machine, but also can apply an alternating current and a direct current electric field between the rollers, and introduces an electrochemical action to induce physical and chemical changes of particles or solutions in the system, thereby increasing the mutual Interaction force to improve grinding and dispersion efficiency.

The technical solution for realizing the present invention is: a roller press machine capable of applying an electric field, which includes a base, a frame, a press roller, a press roller space adjusting device, a speed adjusting device, a voltage applying device, a feeding baffle and a discharging device, wherein a roller surface of the press roller is made of a conductive material.

In order to realize the formation of an electric field between the press rollers, the following methods can be used: 1) the press rollers are fixed to the frame by bearings, the bearings are made of an insulating material; 2) the surface layer of the press rollers is made of a conductive material, the central axis of an inner layer is made of an insulating material; the press roller has a three-layer composite structure comprising a roller surface of an outer layer made of a conductive material, an insulating interlayer in the middle and a central axis at an inner layer, and the insulating interlayer is made of an insulating material.

The roller press machine generally comprises at least two press rollers. The purpose of designing the bearing, the central shaft or the insulating interlayer to be made of an insulating material is to prevent the charge on the surface of the press roller from being transferred to other parts of the roller press machine, and to ensure that the electric charge is only distributed on the surface of the press roller.

The frame further comprises a brush fixing device. The brush fixing device comprises a Y-shaped brush holder, a graphite brush provided at a lower end of the Y-shaped brush holder, and the graphite brush is in contact with the roller surface of the press roller.

The conductive material is an iron-based alloy, a nickel-chromium alloy, a chromium carbide alloy, a high manganese alloy, a tungsten carbide alloy, a nickel-tungsten alloy, a titanium alloy, an aluminum alloy, a magnesium alloy, a copper alloy, or a nickel alloy.

The insulating material is polyamide, polytetrafluoroethylene, polyethylene, heat resistant epoxy resin, phenolic resin, polyoxymethylene, fluoroplastic, polyimide, silicone/polyphenylene sulfide, chlorinated polyether, zirconia or alumina.

The number of the press rollers is at least two, and charges are applied between adjacently positioned press rollers to form an alternating current and a direct current electric field. The voltage application method can be as follows: if the number of press rollers is an even number, such as a roller press machine with 2 press rollers, the applied voltage is positive and negative. The applied voltage for a roller press machine with 4 press rollers is positive, negative, positive and negative. If the number of press rollers is an odd number, such as a roller press machine with 3 press rollers, the applied voltage is positive, negative, positive, or negative, positive, negative; or can also be positive, zero, negative.

The press roller is mounted on the frame through a bearing, the frame comprises a feeding device and a discharging device, the feeding device comprises a feeding baffle, the feeding baffle is positioned at two sides of the press roller, the discharging device comprises a discharging plate and a scraper, the scraper is fixed on a top end of the discharging plate, after the materials are pressed by the press roller and are carried out by the press roller at an discharging end, the materials are scraped by the scraper and then flow out through the discharging plate.

The feeding baffle is perpendicular to the roller surface of the press roller and a lower end of the feeding baffle is fittingly in contact with the roller surface.

The scraper and the press roller at the discharge end define an angle, and the angle is 10° to 45°.

The application of an electric field between the rollers according to the present invention, in particular, is by designing an insulated brush fixing device, wherein the Y-shaped brush holder is pressed tightly on one end surface of the press roller so that the brush and the roller surface are fittingly in contact with each other, and the brush is a conventional graphite brush, and a wire is used to connect the carbon brush terminal to the output terminal of the DC or AC power supply.

The advantageous effect of the present invention is as follows: 1. Through a three-layer composite structure design of the press roller, a DC electric field or an AC electric field can be applied between the press rollers of the roller press machine. At the same time, the insulation between the roller surface and the main structure of the roller press machine is ensured so that the electric charge on the press roller is only distributed on the surface of the press roller without shifting.

2. In the roller press machine capable of applying an electric field, under the action of an electric field, the particles in the solid-liquid dispersion system are polarized, the interaction between the dispersed phase and the solvent phase is enhanced, and the grinding efficiency is improved.

3. Under the action of an electric field, the particles in the solid-liquid dispersion are polarized to produce an orientation, which can make the orientation of the particles match the direction of movement of the roller surface of the press roller, thereby enhancing the shear effect.

4. The electrochemical reaction can occur simultaneously during the rolling process through the preferred reaction system, thus the mechanical force and the electrochemical force are superposed together to produce a unique grinding effect.

DETAILED DESCRIPTION OF THE PREFERRED EMBODIMENT

Figure 2:
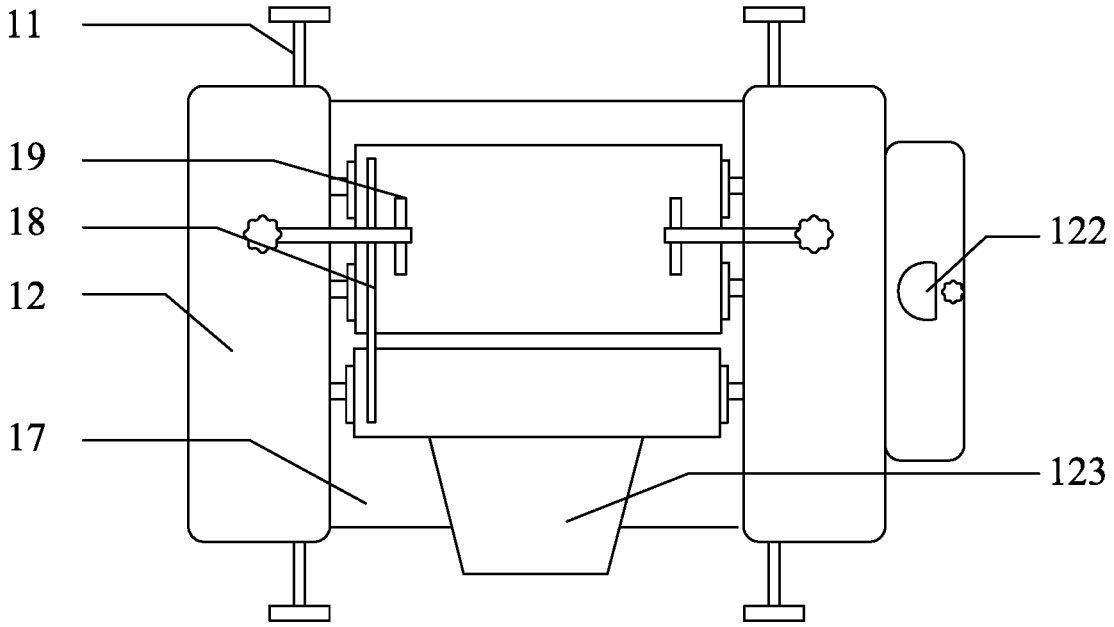
FIG. 2 is a schematic structural diagram of the roller press machine.
Figure 3:
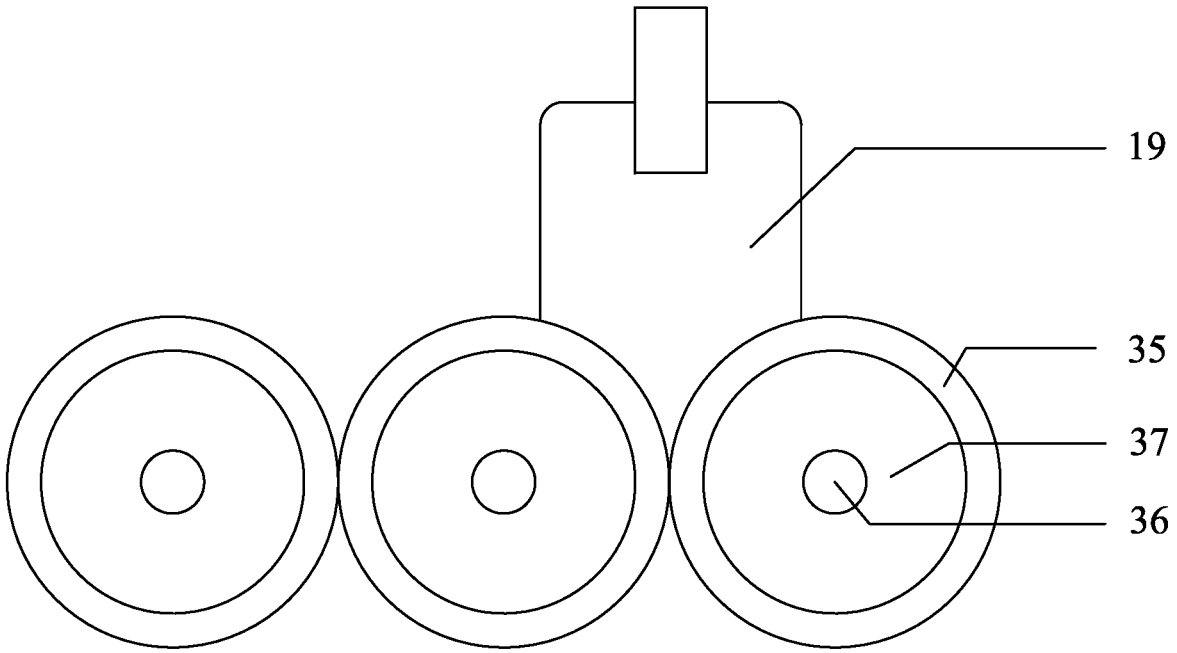
FIG. 3 is a schematic diagram showing a feeding baffle of the roller press machine.
Figure 4:
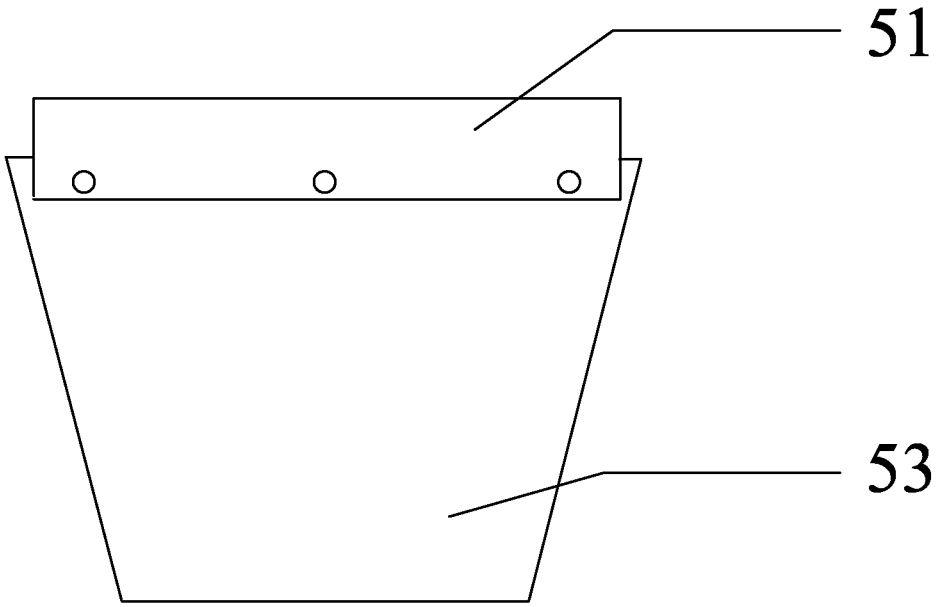
FIG. 4 is a schematic structural diagram showing a discharging plate of the roller press machine.

Referring to FIGS. 2, 3 and 4 of the drawings, the present invention provides a roller press machine capable of applying an electric field, which includes a base, a frame 12, a press roller, a press roller space adjusting device 11, a speed adjusting device 122, a voltage applying device, a feeding baffle 19 and a discharging device. The two adjacently positioned press rollers are electrically insulated, and a roller surface of the press roller is made of a conductive material.

The press roller is mounted on the frame 12 through a bearing. The frame include a feeding device and a discharging device. The feeding device comprises the feeding baffle 19. The feeding baffle 19 is positioned at two sides of the press roller. The discharging device comprises a discharging plate 53 and a scraper 51. The scraper 51 is affixed on a top end of the discharging plate 53. After the materials are pressed by the press roller and are carried out by the press roller at the discharging end, the materials are scraped by the scraper 51 and then flow out through the discharging plate 53.

The press roller is mounted on the frame 12 through a mechanical bearing. The rotational speed of the press roller is adjusted by a vector inverter 121. The spacing between the press rollers is adjusted by a rotary handle which is in close contact with the frame 12. The number of feeding baffles 19 is two, and the two feeding baffles 19 are positioned at two sides of the press roller at the feeding end, and is perpendicular to a roller surface and a lower end is in contact with the roller surface. The feeding baffle 19 is made of polytetrafluoroethylene, and its thickness is fixed on the steel frame by fixing screws, and the lower end is processed into a concave curved edge on two sides, so that it fits tightly with the roller surface.

The scraper 51 and the press roller at the discharge end define an angle, and the angle is 10° to 45°.

The frame further comprises a brush fixing device 32. The brush fixing device 32 comprises a Y-shaped brush holder 33, a graphite brush 34 provided at a lower end of the Y-shaped brush holder 33, and the graphite brush 34 is in contact with the roller surface 35 of the press roller.

The graphite brush 34 can press onto the roller surface, and of course, can also press onto the side of the roller, or even press onto the support shaft if the above design is a single-layer design.

During application, the graphite brush 34 is energized, the brush is in contact with the press roller, and a DC electric field can be applied like the press roller, and at the same time, the insulation design of the press roller can make the electric charge on the press roller only distribute on the surface of the press roller without shifting.

Embodiment 1

The number of the press rollers is at least two, and charges of different polarities are applied between adjacent press rollers.

Depending on the number of press rollers, there are a variety of electric field application methods. For example, when there are two or more press rollers, opposite polarity charges can be applied to adjacent press rollers. For example, if there are 4 press rollers, then the first and the third press rollers are applied with positive charge, and the second and the fourth press rollers are applied with negative charge.

Embodiment 2

The number of the press rollers is at least n+1, wherein n is an even number except 0, no charge is applied to the n-th press roller, different polarity charges are applied to the two press rollers adjacent to the n-th press roller.

When the number of press rollers is 3, 5, 7, 9 . . . , the manner of applying an electric field may be +, 0, −, 0, +, 0, −, 0 means no electric field is applied. That is, positive charges are applied to odd-numbered rollers such as 1, 3, and 5, and negative charges are applied to even-numbered rollers such as 2, 4, and etc.

Of course, the manner of applying an electric field can also be the same as in Embodiment 1, and an electric field of different polarity is disposed between two adjacent press rollers.

Embodiment 3

A three press rollers type is illustrated as an example. The adjacent press rollers are electrically insulated, and the roller surface of the press roller is made of a conductive material. In order to achieve electrical insulation between adjacent press rollers, the press rollers are fixed to the frame by bearings, and the bearings being made of insulating material.

The electric field can be applied in the form of +, +. That is, a positive charge is applied to the first and third press rollers, and a negative charge is applied to the second press roller.

The electric field application for the three press rollers can also be: +, 0, −. That is, no electric field is applied to the second press roller, and an electric field of opposite polarity is applied only to the first and third press rollers so that the press rollers have different charges.

Embodiment 4

Figure 1:
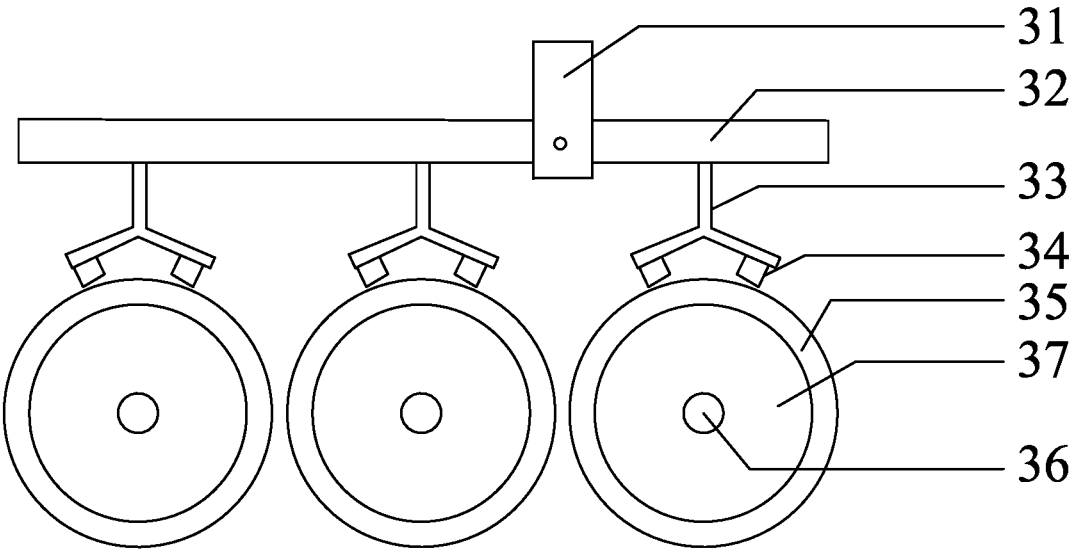
FIG. 1 is a schematic structural diagram showing the three-layer composite structure of a press roller of the roller press machine.

As shown in FIG. 1, the press roller has a three-layer composite structure comprising a roller surface 35 at an outer layer made of a conductive material, an insulating interlayer 37 at the middle and a central axis 36 at an inner layer, and the insulating interlayer 37 is made of an insulating material.

Embodiment 5

The press roller comprises a roller surface 35 at an outer layer made of a conductive material, and a central axis 36 at an inner layer, and the central axis 36 is made of an insulating material.

Preferably, the conductive material refers to an iron-based alloy, a nickel-chromium alloy, a chromium carbide alloy, a high manganese alloy, a tungsten carbide alloy, a nickel-tungsten alloy, a titanium alloy, an aluminum alloy, a magnesium alloy, a copper alloy, or a nickel alloy.

Preferably, the insulating material refers to polyamide, polytetrafluoroethylene, polyethylene, heat resistant epoxy resin, phenolic resin, polyoxymethylene, fluoroplastic, polyimide, silicone/polyphenylene sulfide, chlorinated polyether, zirconia or alumina.

What is claimed is:

1. A roller press machine configured to apply an electric field, comprising a base, a frame, at least two press rollers, a roller distance adjusting device for adjusting a distance between two said press rollers, a speed adjusting device, a voltage applying device, a feeding baffle and a discharging device, wherein each said press roller has a roller surface made of a conductive material such that an electrical field is induced through said roller surface when charges is applied to said roller surfaces of said press rollers, wherein each said press roller is mounted on said frame through a bearing, and said bearing is made of an insulating material.

2. The roller press machine configured to apply an electric field according to claim 1, wherein said roller surface is provided at an outer layer of each said press roller, and a central axis made of an insulating material is provided at an inner layer of each said press roller.

3. The roller press machine configured to apply an electric field according to claim 1, wherein each said press roller has a three-layer composite structure formed by said roller surface at the outer layer, said central axis at the inner layer, and an insulating interlayer between said roller surface and said central axis.

4. The roller press machine configured to apply an electric field according to claim 1, wherein said frame comprises a brush fixing device, said brush fixing device comprises a Y-shaped brush holder and a graphite brush at a lower end of said Y-shaped brush holder for each said press roller respectively, wherein each said graphite brush is in contact with one said corresponding roller surface of said press roller.

5. The roller press machine configured to apply an electric field according to claim 1, wherein said conductive material is an iron-based alloy, a nickel-chromium alloy, a chromium carbide alloy, a high manganese alloy, a tungsten carbide alloy, a nickel-tungsten alloy, a titanium alloy, an aluminum alloy, a magnesium alloy, a copper alloy, or a nickel alloy.

6. The roller press machine configured to apply an electric field according to claim 1, wherein said insulating material is polyamide, polytetrafluoroethylene, polyethylene, heat resistant epoxy resin, phenolic resin, polyoxymethylene, fluoroplastic, polyimide, silicone/polyphenylene sulfide, chlorinated polyether, zirconia or alumina.

7. The roller press machine configured to apply an electric field according to claim 1, wherein charges are applied between two said adjacently positioned press rollers to form an alternating current and a direct current electric field.

8. The roller press machine configured to apply an electric field according to claim 1, wherein a number of the press roller is at least n+1, where n refers to an even number excluding 0, no charge is applied to the n-th press roller, charges are applied to said press rollers adjacent to the n-th press roller to form an alternating current and a direct current electric field.

9. The roller press machine configured to apply an electric field according to claim 1, wherein said press roller is mounted on the frame through a bearing, said feeding baffle is positioned at two sides of said press roller, and said discharging device comprises a discharging plate and a scraper, said scraper is fixed on a top end of said discharging plate, thereby after a material is pressed by said press rollers and is carried away by said press rollers at an discharging end, the material is scraped by said scraper and then flows out through said discharging plate.

10. The roller press machine configured to apply an electric field according to claim 3, wherein said conductive material is an iron-based alloy, a nickel-chromium alloy, a chromium carbide alloy, a high manganese alloy, a tungsten carbide alloy, a nickel-tungsten alloy, a titanium alloy, an aluminum alloy, a magnesium alloy, a copper alloy, or a nickel alloy.

11. The roller press machine configured to apply an electric field according to claim 2, wherein said insulating material is polyamide, polytetrafluoroethylene, polyethylene, heat resistant epoxy resin, phenolic resin, polyoxymethylene, fluoroplastic, polyimide, silicone/polyphenylene sulfide, chlorinated polyether, zirconia or alumina.

12. The roller press machine configured to apply an electric field according to claim 3, wherein said insulating material is polyamide, polytetrafluoroethylene, polyethylene, heat resistant epoxy resin, phenolic resin, polyoxymethylene, fluoroplastic, polyimide, silicone/polyphenylene sulfide, chlorinated polyether, zirconia or alumina.

13. The roller press machine configured to apply an electric field according to claim 4, wherein said conductive material is an iron-based alloy, a nickel-chromium alloy, a chromium carbide alloy, a high manganese alloy, a tungsten carbide alloy, a nickel-tungsten alloy, a titanium alloy, an aluminum alloy, a magnesium alloy, a copper alloy, or a nickel alloy.

14. The roller press machine configured to apply an electric field according to claim 4, wherein said insulating material is polyamide, polytetrafluoroethylene, polyethylene, heat resistant epoxy resin, phenolic resin, polyoxymethylene, fluoroplastic, polyimide, silicone/polyphenylene sulfide, chlorinated polyether, zirconia or alumina.

15. The roller press machine configured to apply an electric field according to claim 13, wherein said insulating material is polyamide, polytetrafluoroethylene, polyethylene, heat resistant epoxy resin, phenolic resin, polyoxymethylene, fluoroplastic, polyimide, silicone/polyphenylene sulfide, chlorinated polyether, zirconia or alumina.

16. The roller press machine configured to apply an electric field according to claim 15, wherein charges are applied between two said adjacently positioned press rollers to form an alternating current and a direct current electric field.

17. The roller press machine configured to apply an electric field according to claim 16, wherein said press roller is mounted on the frame through a bearing, said feeding baffle is positioned at two sides of said press roller, and said discharging device comprises a discharging plate and a scraper, said scraper is fixed on a top end of said discharging plate, thereby after a material is pressed by said press rollers and is carried away by said press rollers at an discharging end, the material is scraped by said scraper and then flows out through said discharging plate.

18. The roller press machine configured to apply an electric field according to claim 2, wherein said frame comprises a brush fixing device, said brush fixing device comprises a Y-shaped brush holder and a graphite brush at a lower end of said Y-shaped brush holder for each said press roller respectively, wherein each said graphite brush is in contact with one said corresponding roller surface of said press roller.

19. The roller press machine configured to apply an electric field according to claim 3, wherein said frame comprises a brush fixing device, said brush fixing device comprises a Y-shaped brush holder and a graphite brush at a lower end of said Y-shaped brush holder for each said press roller respectively, wherein each said graphite brush is in contact with one said corresponding roller surface of said press roller.

* * * * *